US008041252B2

(12) United States Patent
Kondo

(10) Patent No.: US 8,041,252 B2
(45) Date of Patent: Oct. 18, 2011

(54) IMAGE FORMING APPARATUS

(75) Inventor: Hakudai Kondo, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 651 days.

(21) Appl. No.: 12/138,790

(22) Filed: Jun. 13, 2008

(65) Prior Publication Data

US 2008/0309206 A1 Dec. 18, 2008

(30) Foreign Application Priority Data

Jun. 14, 2007 (JP) ..... 2007-157263

(51) Int. Cl.
*G03G 15/00* (2006.01)

(52) U.S. Cl. ..... 399/107

(58) Field of Classification Search ..... 399/107, 399/109; 347/108, 152, 170, 222, 245, 263
See application file for complete search history.

(56) References Cited

U.S. PATENT DOCUMENTS

| | | | | |
|---|---|---|---|---|
| 5,521,681 | A * | 5/1996 | Nimura et al. | 399/102 |
| 5,570,159 | A * | 10/1996 | Hirose et al. | 399/107 |
| 7,051,941 | B2 * | 5/2006 | Yui | 235/462.43 |
| 7,415,224 | B2 | 8/2008 | Hayakawa | |
| 2006/0093398 | A1 | 5/2006 | Hayakawa | |

FOREIGN PATENT DOCUMENTS

| | | | |
|---|---|---|---|
| JP | 4-328585 | A | 11/1992 |
| JP | 7-279923 | A | 10/1995 |
| JP | 09-120187 | | 5/1997 |
| JP | 10-209596 | A | 8/1998 |
| JP | 2001-228659 | A | 8/2001 |
| JP | 2001-242669 | A | 9/2001 |
| JP | 2002-169353 | | 6/2002 |
| JP | 2002-214900 | | 7/2002 |
| JP | 2004-155041 | | 6/2004 |
| JP | 2006-154746 | A | 6/2006 |

OTHER PUBLICATIONS

JP Office Action dtd Apr. 28, 2009, JP Appln. 2007-157263, partial English Translation.
Notification of Reasons for Refusal drafted Nov. 5, 2010 in Japanese Application No. 2007-157263 and English translation thereof.

* cited by examiner

*Primary Examiner* — David Gray
*Assistant Examiner* — Gregory H Curran
(74) *Attorney, Agent, or Firm* — Banner & Witcoff, Ltd

(57) ABSTRACT

An image forming apparatus and printer are provided. The image forming apparatus includes a plurality of side frames opposed to each other; an intermediate frame provided between the plurality of side frames; a plurality of first screws for connecting the side frames and the intermediate frame at first mutually opposed positions of the side frames; and a plurality of second screws for connecting the side frames and the intermediate frame at second mutually opposed positions of the side frames; wherein a distance between the first mutually opposed positions of the first screws is narrower than a distance between the second mutually opposed positions of the second screws.

10 Claims, 5 Drawing Sheets

IMAGE FORMING APPARATUS

CROSS REFERENCE TO RELATED APPLICATION

The present application claims priority from Japanese Patent Application No. 2007-157263, which was filed on Jun. 14, 2007, the disclosure of which is herein incorporated by reference in its entirety.

TECHNICAL FIELD

Apparatuses consistent with the present invention relate to an image forming apparatus and, more particularly, to an image forming apparatus having improved structural stability.

BACKGROUND

A related art image forming apparatus is described in Japanese Patent Application Nos. JP-A-9-120187, JP-A-2002-169353, and JP-A-2002-214900. The related art image forming apparatus is provided with one pair of side frames opposed to each other, and an intermediate frame that axially supports various kinds of rollers and is disposed between the pair of side frames. Screws are fastened at corresponding positions to connect between one side frame and the intermediate frame and between the other side frame and the intermediate frame.

SUMMARY

However, the related art image forming apparatus as described in the above documents has a couple of disadvantages. A distance between the thread fastened position between one side frame and the intermediate frame and the thread fastened position between the other side frame and the intermediate frame, the thread fastened positions corresponding to each other, is the same in any case. That is, since the shape formed by joining the thread fastening positions is a square or rectangle, there is a problem in that the overall strength of the frame composed of one pair of side frames and the intermediate frame is weak.

Exemplary embodiments of the present invention address the above disadvantages and other disadvantages not described above. However, the present invention is not required to overcome the disadvantages described above, and thus, an exemplary embodiment of the present invention may not overcome any of the problems described above.

It is an aspect of the invention to provide an image forming apparatus in which the overall strength of the frame composed of one pair of side frames and the intermediate frame can be increased.

According to an exemplary embodiment of the present invention, an image forming apparatus comprises a plurality of side frames opposed to each other; an intermediate frame provided between the plurality of side frames; a plurality of first screws for connecting the side frames and the intermediate frame at first mutually opposed positions of the side frames; and a plurality of second screws for connecting the side frames and the intermediate frame at second mutually opposed positions of the side frames; wherein a distance between the first mutually opposed positions of the first screws is narrower than a distance between the second mutually opposed positions of the second screws.

According to another exemplary embodiment of the present invention, an image forming apparatus comprises two side frames opposed to each other; an intermediate frame provided between the two side frames; two first screws for connecting the side frames and the intermediate frame at first mutually opposed positions of the side frames; and two second screws for connecting the side frames and the intermediate frame at second mutually opposed positions of the side frames; wherein a distance between the first mutually opposed positions of the first screws is narrower than a distance between the second mutually opposed positions of the second screws.

According to another exemplary embodiment of the present invention, a printer is provided that comprises a first side frame comprising a first projection portion; a second side frame comprising a second projection portion, wherein the first side frame and the second side frame are arranged such that the first and second projection portions project towards each other; an intermediate frame; two first connectors which connect the intermediate frame to the first projection portion and second projection portion respectively; and two second connectors which connect the intermediate frame to the first side frame and the second side frame respectively.

BRIEF DESCRIPTION OF THE DRAWINGS

Illustrative aspects of the invention will be described in detail with reference to the following figures wherein.

DETAILED DESCRIPTION OF EXEMPLARY EMBODIMENTS OF THE PRESENT INVENTION (Overall Description)

Figure 1:
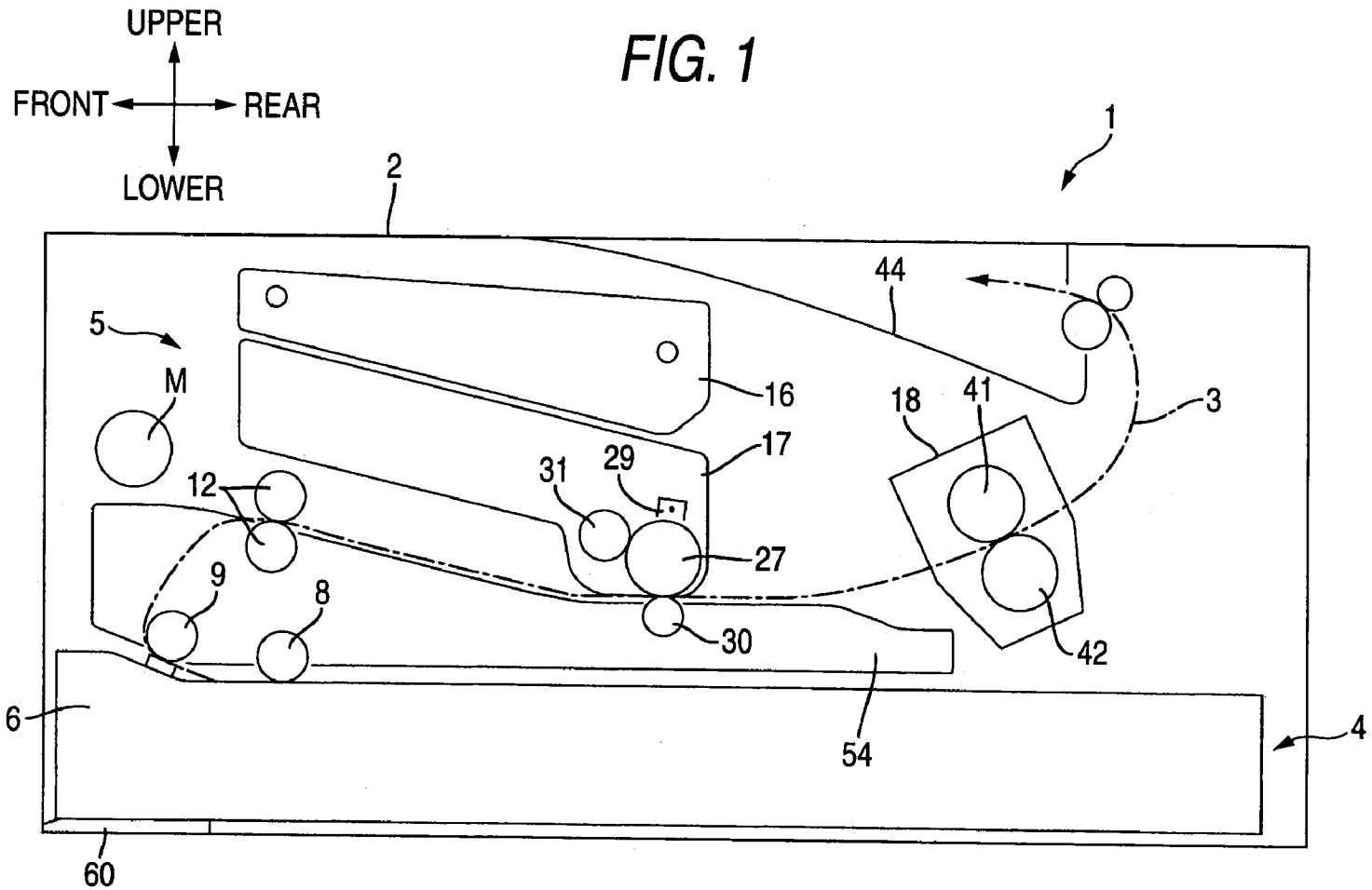
FIG. 1 is a schematic view showing an image forming apparatus according to an exemplary embodiment of the present invention.

FIG. 1 is a side cross-sectional view showing an image forming apparatus according to an exemplary embodiment of the present invention. In this exemplary embodiment, the image forming apparatus is embodied in the form of a printer 1. However, the present inventive concept applies to any electronic apparatus that contains a frame that supports roller elements. In the following description, it is supposed that the left side on the paper in FIG. 1 is the front side of the printer 1, and the right side on the paper in FIG. 1 is the back side of the printer 1. In FIG. 1, the printer 1 comprises a main body case 2 comprising a feeder unit 4 for feeding a printing medium, in this case a paper 3, and an image forming unit 5 for forming the image on the fed paper 3 in the main body case 2.

(1) Feeder Unit

The feeder unit 4 comprises a storage cassette, in this case a sheet feed tray 6, a sheet feed roller 8, a separation roller 9, and a registration roller 12. The paper 3 on the top of the sheet feed tray 6 is fed by the feed roller 8, and fed one by one with the rotation of the separation roller 9. The fed paper 3 is registered by the registration roller 12 and fed to a transfer position.

(2) Image Forming Unit

The image forming unit 5 comprises a scanner unit 16, a process cartridge 17 and a fixing unit 18. The scanner unit 16 has a laser emitting unit and a polygon mirror (not shown) A laser beam emitted from the laser emitting unit is deflected by the polygon mirror, and applied onto the surface of a photosensitive drum 27.

Also, the process cartridge 17 has a developing unit, in this case a developing roller 31, a photosensitive drum 27, a scorotron type charger unit 29 and a transfer roller 30. The charger unit 29 positively charges the surface of the photosensitive drum 27 uniformly. Thereafter, the surface of the photosensitive drum 27 is exposed by the laser beam from the scanner unit 16 so that an electrostatic latent image is formed thereon. Then, the toner carried on the surface of the developing roller 31 is supplied to the electrostatic latent image formed on the photosensitive drum 27, so that the electrostatic latent image is developed.

When the paper 3 passes through the transfer position, a transfer voltage is applied to the transfer roller 30, so that a toner image on the photosensitive drum 27 is transferred onto the paper 3. The fixing unit 18 thermally fixes the toner on the paper 3 while the paper 3 passes between a heating roller 41 and a pressing roller 42. Thereafter, the paper 3 after thermal fixing is exhausted onto a sheet discharging tray 44.

(Frame Structure)

Figure 2:
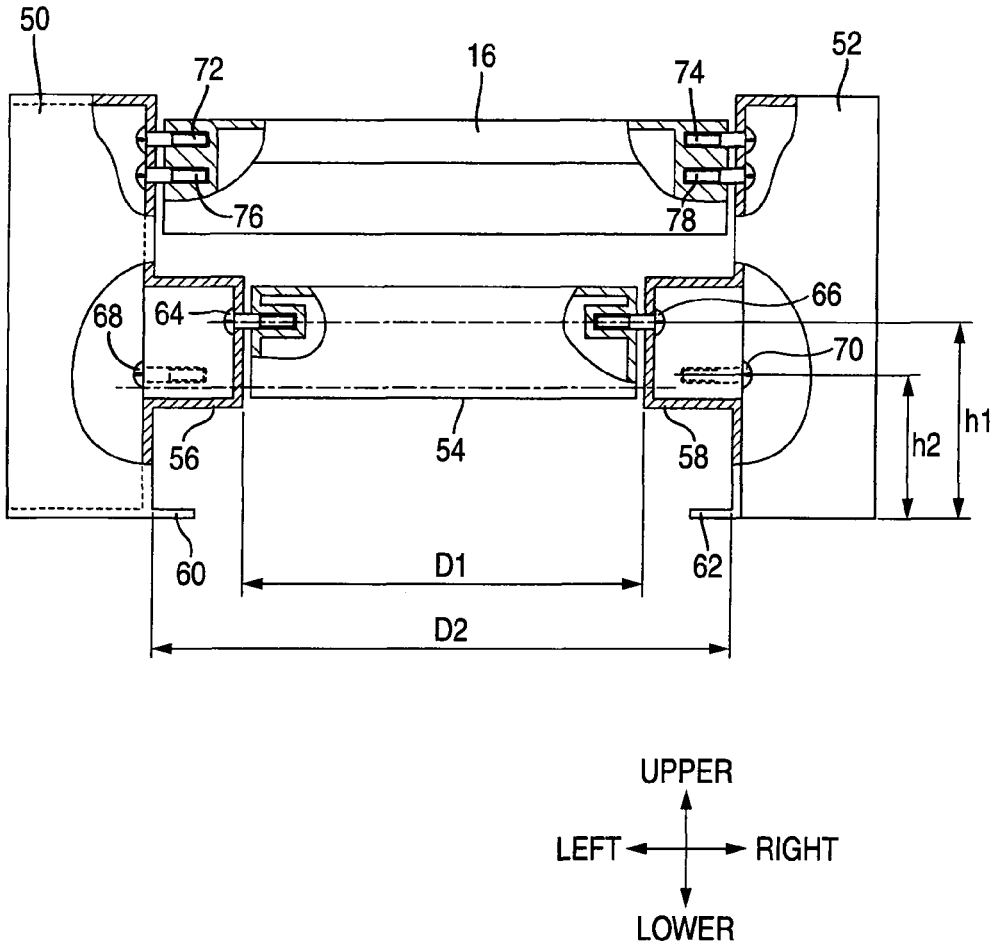
FIG. 2 is a front view of a frame structure of the image forming apparatus of FIG. 1.
Figure 3:
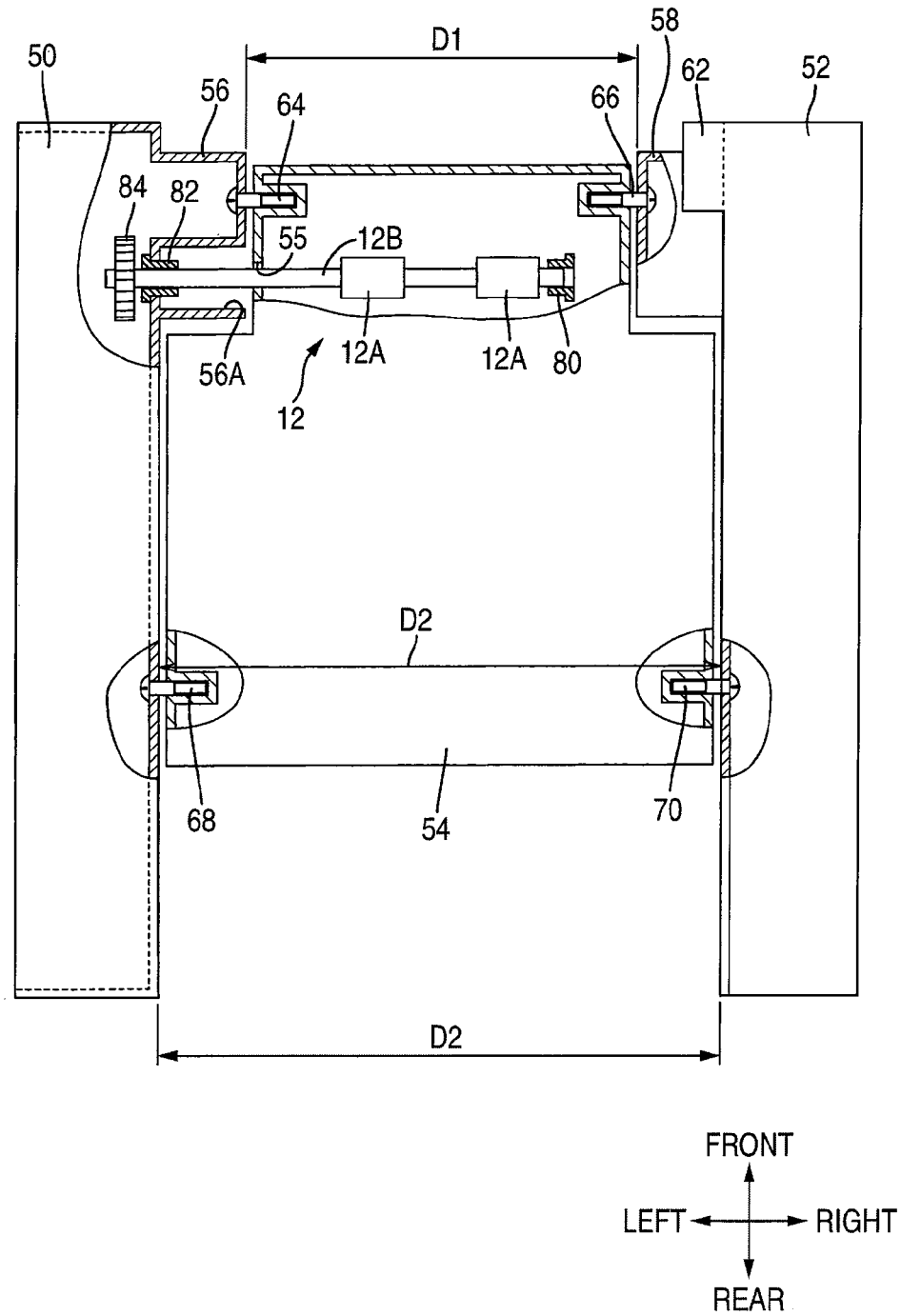
FIG. 3 is a bottom view of the frame structure of the image forming apparatus of FIG. 1.

FIG. 2 is a front view of a frame structure of the printer 1 according to an exemplary embodiment of the present invention as seen from the front (i.e., a front side of the paper is the front side of the printer 1), and FIG. 3 is a bottom view of the frame structure of the printer 1 (i.e., the upper side of the paper is the front side of the printer 1). The printer 1 has a structure in which an intermediate frame, in this case a paper feed frame 54 and a scanner unit 16 are sandwiched between a pair of side frames 50, 52 disposed on the left and right side of the intermediate frame, respectively.

Figure 4:
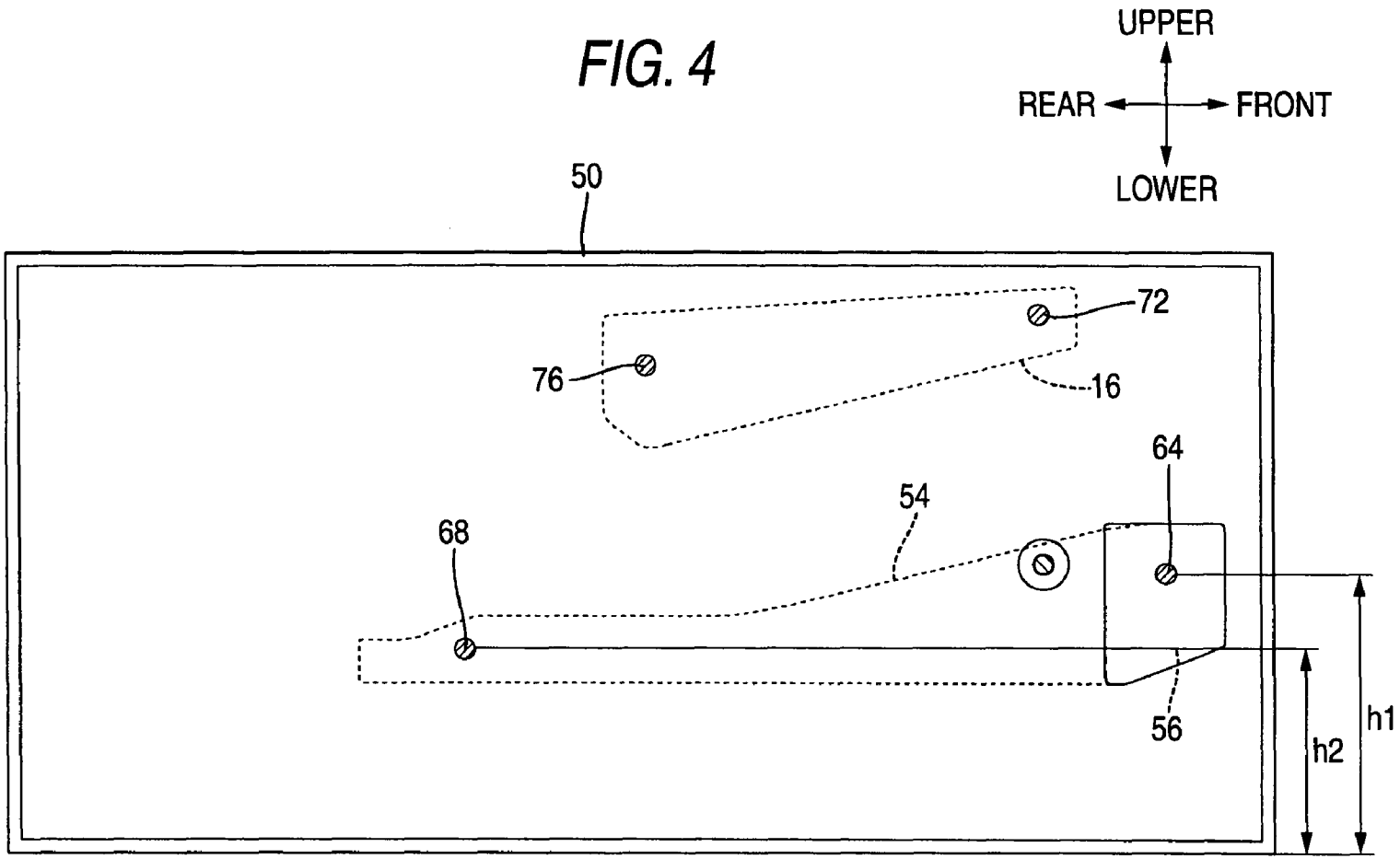
FIG. 4 is a side view of a left side frame of the image forming apparatus of FIG. 1 as seen from the left.
Figure 5:
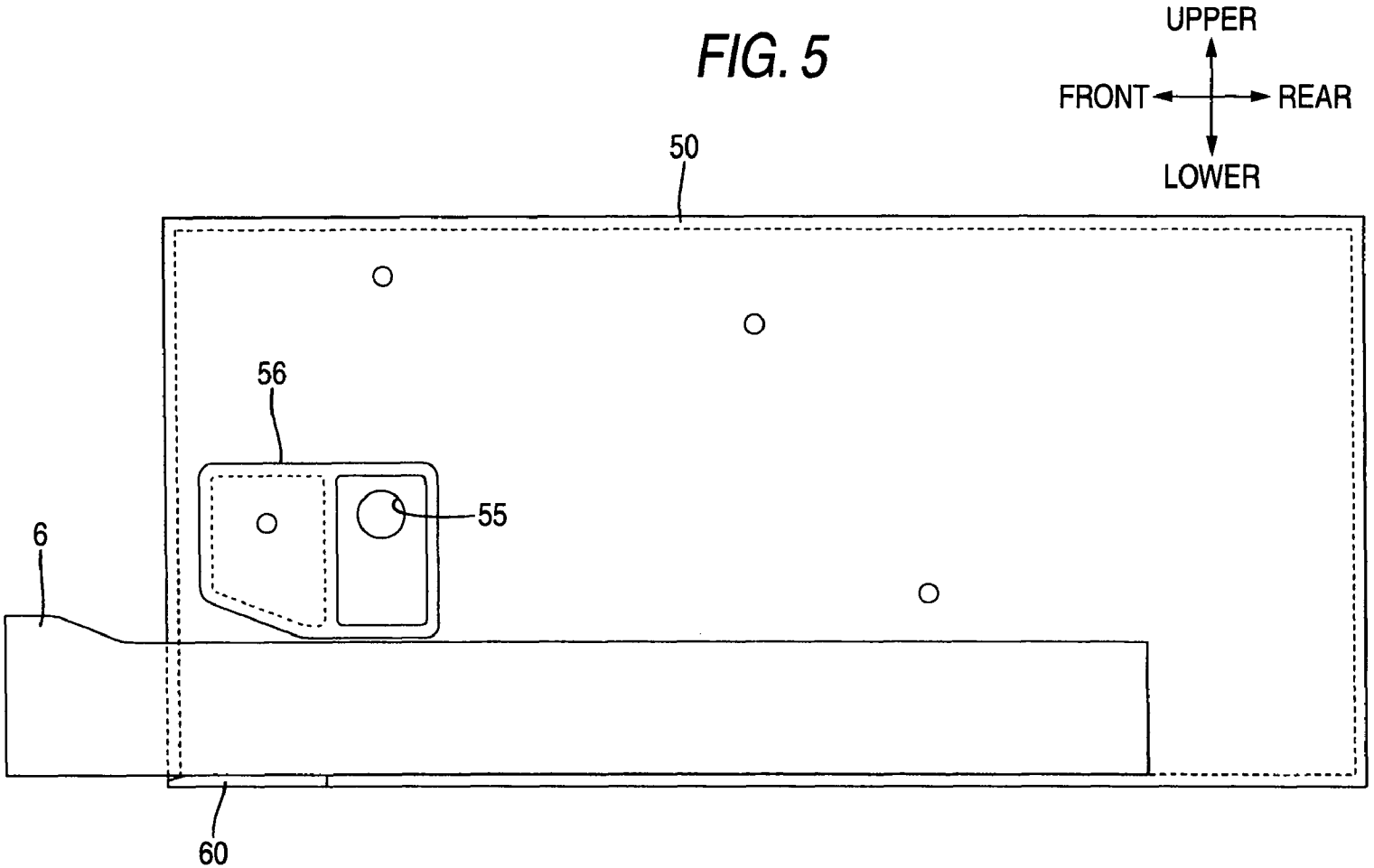
FIG. 5 is a side view of the left side frame of the image forming apparatus of FIG. 1 as seen from the right.

FIG. 4 is a side view of a left side frame 50 as seen from the outside (left side), and FIG. 5 is a side view of the left side frame 50 as seen from the inside (right side).

Each of the side frames 50, 52 has a box shape in which an outer surface directed to the outside of the printer 1 is opened, and an inner wall directed to the inside of the printer 1 has a convex portion 56, 58, respectively, swollen like a rectangle in its front portion. Also, a collar portion 60, 62 is provided under the respective convex portion 56, 58 (see FIG. 2). On the other hand, the paper feed frame 54 has a shape like a plate as a whole, and hollow in a portion corresponding to each convex portion 56, 58. The paper feed frame 54 has a smooth and uneven upper portion to guide the paper 3 smoothly.

The paper feed frame 54 is secured to the convex portions 56 and 58 of the side frames 50 and 52 by a pair of first screws 64 and 66, and secured to the back ends of the side frames 50 and 52 by a pair of second screws 68 and 70, as shown in FIGS. 2 and 3. The thread fastening positions of the first screws 64 and 66 and the thread fastening positions of the second screws 68 and 70 have different heights, as shown in FIG. 2.

The thread fastening positions of the first screws 64 and 66 are located on a straight line along the lateral direction of the printer 1. In other words, the thread fastening positions of the first screws 64 and 66 are located at the opposed positions, i.e., a pair of positions with the shortest distance, of the side frames 50 and 52. Likewise, the thread fastening positions of the second screws 68 and 70 are located on a straight line along the lateral direction of the printer 1. In other words, the thread fastening positions of the second screws 68 and 70 are located at the opposed positions, i.e., a pair of positions with the shortest distance, of the side frames 50 and 52.

Also, the paper feed frame 54 is provided with the registration roller 12 (on the lower side) together with the separation roller 9, as shown in FIG. 3. This registration roller 12 comprises a pair of roller portions 12A, 12A arranged in the lateral direction, and a roller shaft 12B, and is provided near the thread fastening positions of the first screws 64 and 66 in the hollow portions corresponding to the convex portions 56 and 58.

Specifically, a bearing portion 80 is provided within the paper feed frame 54 to bear one end of the roller shaft 12B. The other end of the roller shaft 12B projects outward via a through hole 55 provided through a side wall of the paper feed frame 54. On the other hand, the convex portion 56 of the left side frame 50 has an outwardly hollow portion 56A, and a bearing portion 82 is provided in the hollow portion 56A. The other end of the roller shaft 12B, which projects through the through hole 55, is borne by the bearing portion 82, and has a gear 84 for receiving a driving force from a drive motor M, not shown. In the figures, a mechanism for transmitting the driving force from the drive motor M to the gear 84 is omitted.

Also, the scanner unit 16 is secured between the side frames 50 and 52 by a pair of third screws 72 and 74 and a pair of fourth screws 76 and 78 (see FIG. 2).

Effects of the First Exemplary Embodiment

According to the first exemplary embodiment of the present invention, the paper feed frame 54 is secured between the side frames 50 and 52 by the first screws 64 and 66 and the second screws 68 and 70. The distance spacing D1 between the thread fastening positions of the first screws 64 and 66 is shorter than the distance spacing D2 between the thread fastening positions of the second screws 68 and 70, as shown in FIGS. 2 and 3. As shown in FIG. 2 and FIG. 3, a distance between positions where the first screws 64 and 66 connect the side frames 50 and 52 and the paper feed frame 54 is the distance spacing D1 between first mutually opposed positions of the side frames 50 and 52. And, a distance between positions where the second screws 68 and 70 connect the side frames 50 and 52 and the paper feed frame 54 is the distance spacing D2 between second mutually opposed positions of the side frames 50 and 52. That is, a shape formed by joining the first screws 64 and 66 and the second screws 68 and 70 is trapezoidal. Accordingly, the strength of the frame structure which comprises one pair of side frames 50 and 52 and the paper feed frame 54 can be greater than a case in which a shape formed by joining the thread fastening positions is square or rectangular. In addition, although there is a clearance between the side frames 50 and 52 and the paper feed frame 54 in FIG. 2 and FIG. 3, the side frames 50 and 52 could be firmly connected to the paper feed frame 54 by the first screws 64 and 66 and the second screws 68 and 70 such that there is substantially no clearance between the side frames 50 and 52 and the paper feed frame 54.

As show in FIG. 2 and FIG. 4, the sign "h1" denotes a distance between the thread fastening positions of the first screws (64, 66) and a bottom face of the printer 1, in a direction perpendicular to the bottom face of the printer 1. The sign "h2" denotes a distance between the thread fastening positions of the second screws (68, 70) and the bottom face of the printer 1, in the direction perpendicular to the bottom face of the printer 1. As shown in FIG. 2 and FIG. 4, the distance h1 is larger than the distance h2. In other words, a height of the thread fastening positions of the first screws (64, 66) is higher than a height of the thread fastening positions of the second screws (68, 70). According to the first exemplary embodiment of the present invention, the thread fastening positions of the first screws 64 and 66 and the thread fastening positions of the second screws 68 and 70 have different heights. Accordingly, the strength of the frame structure can be further greater than a case in which the first screws and the second screws have a same height.

According to the first exemplary embodiment of the present invention, the registration roller 12 is provided nearer to the thread fastening positions of the first screws 64 and 66 than the positions of the second screws 68 and 70. Since the strength is stronger near the thread fastening positions of the first screws 64 and 66 than near the thread fastening positions of the second screws 68 and 70, it is possible to suppress influence of the load of the frame due to distortion on the rotational motion of the registration roller 12.

According to the first exemplary embodiment of the present invention, the other end of the roller shaft 12B for the registration roller 12 receives a driving force from the drive motor M outside the thread fastening position of the second screw 68 in the first exemplary embodiment. In this case, the other end of the roller shaft 12B is borne at the same position as the thread fastening position of the second screw 68. Thereby, the other end of the roller shaft 12B can be borne at a position near the gear 84 receiving the driving force form the drive motor M, so that the registration roller 12 can be rotated stably.

According to the first exemplary embodiment of the present invention, the lower surfaces of the convex portions 56 and 58 function as a guide for inserting or extracting the sheet feed tray 6, as shown in FIG. 5. Accordingly, the sheet feed tray 6 can be taken in or out smoothly without providing a special guide.

Other Exemplary Embodiments

The present invention is not limited to the exemplary embodiment as described above.

Although the intermediate frame is exemplified as the paper feed frame 54 in the above exemplary embodiment, it may be the scanner unit 16 or the fixing unit 18 as far as it can be sandwiched between a pair of side frames.

Although the conveying roller is exemplified as the registration roller 12 in the above exemplary embodiment, it may be other rollers for conveying the paper 3.

Although the convex portion is provided on each of the side frames in the above exemplary embodiment, the convex portion may be provided on one side frame. Also, each convex portion may have a different protruding length in the case where the convex portion is provided on each of the side frames.

According to the above-described exemplary embodiments of the present invention, the overall strength of the frame comprising a pair of side frames and the intermediate frame can be increased.

While the present invention has been shown and described with reference to certain exemplary embodiments thereof, it will be understood by those skilled in the art that various changes in form and details may be made therein without departing from the spirit and scope of the invention as defined by the appended claims.

What is claimed is:

1. An image forming apparatus comprising:

a plurality of side frames opposed to each other;

a first intermediate frame provided between the plurality of side frames;

a second intermediate frame provided between the plurality of side frames;

a plurality of first screws for connecting the side frames and the first intermediate frame at first mutually opposed positions of the side frames;

a plurality of second screws for connecting the side frames and the first intermediate frame at second mutually opposed positions of the side frames;

a plurality of third screws for connecting the side frames and the second intermediate frame at third mutually opposed positions of the side frames; and a plurality of fourth screws for connecting the side frames and the second intermediate frame at fourth mutually opposed positions of the side frames;

wherein a distance between the first mutually opposed positions is shorter than a distance between the second mutually opposed positions.

2. The image forming apparatus according to claim 1, wherein the first mutually opposed positions of the first screws and the second mutually opposed positions of the second screws have different heights, and wherein a height of the first mutually opposed positions is greater than a height of the second mutually opposed positions.

3. The image forming apparatus according to claim 1, wherein the first intermediate frame comprises a conveying roller provided to be rotatable around an axis which is perpendicular to the side frames, the conveying roller being disposed at a position closer to the first mutually opposed positions of the first screws than the second mutually opposed positions of the second screws.

4. The image forming apparatus according to claim 3, wherein the conveying roller comprises a roller shaft, and one end portion of the roller shaft that receives a driving force from a drive motor is borne at a same position as, or outside a position of, one of the first screws.

5. The image forming apparatus according to claim 4, wherein each of the side frames comprises an inwardly protruding convex portion, the first intermediate frame comprises concave portions which correspond to the convex portions of the side frames, and the first screws fasten the convex portions and the concave portions.

6. The image forming apparatus according to claim 5, further comprising a storage cassette for storing a printing medium, wherein lower surfaces of the convex portions serve as a guide for inserting or discharging the storage cassette.

7. An image forming apparatus comprising:

a plurality of side frames opposed to each other;

an intermediate frame provided between the plurality of side frames;

a plurality of first screws for connecting the side frames and the intermediate frame at first mutually opposed positions of the side frames;

a plurality of second screws for connecting the side frames and the intermediate frame at second mutually opposed positions of the side frames;

wherein a distance between the first mutually opposed positions is shorter than a distance between the second mutually opposed positions, wherein the intermediate frame comprises a conveying roller provided to be rotatable around an axis which is perpendicular to the side frames, the conveying roller being disposed at a position closer to the first mutually opposed positions of the first screws than the second mutually opposed positions of the second screws.

8. The image forming apparatus according to claim 7, wherein the conveying roller comprises a roller shaft, and one end portion of the roller shaft that receives a driving force from a drive motor is borne at a same position as, or outside a position of, one of the first screws.

9. The image forming apparatus according to claim 8, wherein each of the side frames comprises an inwardly protruding convex portion, the intermediate frame comprises concave portions which correspond to the convex portions of the side frames, and the first screws fasten the convex portions and the concave portions.

10. The image forming apparatus according to claim 9, further comprising a storage cassette for storing a printing medium, wherein lower surfaces of the convex portions serve as a guide for inserting or discharging the storage cassette.

* * * * *